US006142048A

United States Patent [19]

Bradatsch et al.

[11] Patent Number: 6,142,048

[45] Date of Patent: Nov. 7, 2000

[54] DUAL ROTATING BLADE CUTTING DEVICE FOR CUTTING A CONTINUOUS MATERIAL

[75] Inventors: Edmund Bradatsch, Weiden; Hans Mosburger, Weiherhammer; Christoph Reis, Etzenricht; Felix Titz, Weiherhammer, all of Germany

[73] Assignee: BHS Corrugated Maschinen- und Anlagenbau GmbH, Weiherhammer, Germany

[21] Appl. No.: 09/000,304

[22] PCT Filed: Apr. 25, 1997

[86] PCT No.: PCT/DE97/00841

§ 371 Date: May 15, 1998

§ 102(e) Date: May 15, 1998

[87] PCT Pub. No.: WO97/44167

PCT Pub. Date: Nov. 27, 1997

[30] Foreign Application Priority Data

May 22, 1996 [DE] Germany ..... 196 20 663

[51] Int. Cl.[7] ..... B26D 1/56

[52] U.S. Cl. ..... 83/341; 83/343; 83/596

[58] Field of Search ..... 83/321, 324, 327, 83/331, 341, 342, 343, 350, 351, 354, 359, 360, 361, 363, 364, 365, 513–519, 411

[56] References Cited

U.S. PATENT DOCUMENTS

| | | | |
|---|---|---|---|
| 3,401,585 | 9/1968 | Schmermund | 83/341 |
| 3,506,518 | 4/1970 | Klein | 83/341 |
| 3,528,333 | 9/1970 | Hornung | 83/341 |
| 4,044,641 | 8/1977 | Burt, Jr. et al. | 83/341 |
| 4,428,263 | 1/1984 | Lindee et al. | 83/354 |
| 4,596,546 | 6/1986 | Schellenberg | 83/347 |
| 4,630,514 | 12/1986 | Ohmori et al. | 83/341 |
| 4,737,904 | 4/1988 | Ominato | 83/365 |
| 4,941,378 | 7/1990 | Snyder | 83/354 |
| 4,955,265 | 9/1990 | Nakagawa et al. | 83/365 |
| 5,041,070 | 8/1991 | Blaser | 83/365 |
| 5,079,981 | 1/1992 | Singer et al. | 83/365 |
| 5,320,017 | 6/1994 | Lecrone | 83/871 |
| 5,515,757 | 5/1996 | O'Connor et al. | 83/347 |

*Primary Examiner*—Rinaldi I. Rada
*Assistant Examiner*—Kim Ngoc Tran
*Attorney, Agent, or Firm*—Russell D. Culbertson; Shaffer & Culbertson, LLP

[57] ABSTRACT

The cutting device (1) for a continuous material, in particular a corrugated web, consists of rotating paired cutter bars (5, 6) mounted in bearings above one another, with blades (8) which run in the lengthwise direction of the cutter bars. Each cutter bar (5, 6) is connected directly with a driving motor (10) on each end (9). A synchronizing device (11, 12, 13) for the cutter bars (5, 6) is present.

FIG. 1 is the main illustration.

8 Claims, 2 Drawing Sheets

DUAL ROTATING BLADE CUTTING DEVICE FOR CUTTING A CONTINUOUS MATERIAL

TECHNICAL FIELD OF THE INVENTION

The invention concerns a cutting device for a continuous material, in particular a corrugated web.

BACKGROUND OF THE INVENTION

A cutting device for web materials is known from DE 36 08 111 C1, which demonstrates two cutter bars positioned over one another. The cutter bar is directly driven on each end by an electric motor. The cutter bars are connected mechanically on both sides by intermeshing gear pairs. The intermeshed gears possess spiral gearing. One gear of a gear pair is movable. The disadvantage is that the angular momentum of all moving components, such as electric motors, gear pairs and cutter bars, is not minimized. Only two driving motors are used for one cutter bar. These motors must deliver the entire driving power for the cutting device. In addition, the intermeshed gears must be unnecessarily strongly constructed, thereby providing a high angular momentum, because the lower cutter bar must be driven with the corresponding torque.

SUMMARY OF THE INVENTION

It is an object of the invention to provide a cutting device whose cutter bars are driven in exact synchronism, despite fluctuating rotational speeds, while the angular momentum of all moving components is minimized. The invention solves this problem by driving each end of a cutting bar pair directly with a drive motor. Because each end of a cutter bar pair is driven directly by a driving motor, the performance required by each motor is reduced, and with it the size of the motor. In this way it is possible to provide each end of each cutter bar with a driving motor which drives it directly. In addition, the angular momentum of each driving motor is minimized. Because the intermeshed gear pairs on the ends of the cutter bars no longer assume any significant burden, they can be constructed correspondingly weakly. The angular momentum of more weakly constructed gears is also minimized.

In one design of the invention the cutter bars are at least partially constructed of fiber-reinforced material, and preferably hollow. This minimizes the angular momentum of the cutter bars, thereby reducing the stress on each motor.

According to another design of the invention, at least one gear pair is constructed without play. This guarantees the cutting quality, because the blades cut one after another exactly in place.

BRIEF DESCRIPTION OF THE DRAWINGS

The invention is explained further with the aid of the examples illustrated in the following drawings. The drawings show.

DESCRIPTION OF THE PREFERRED EMBODIMENTS

Figure 1:
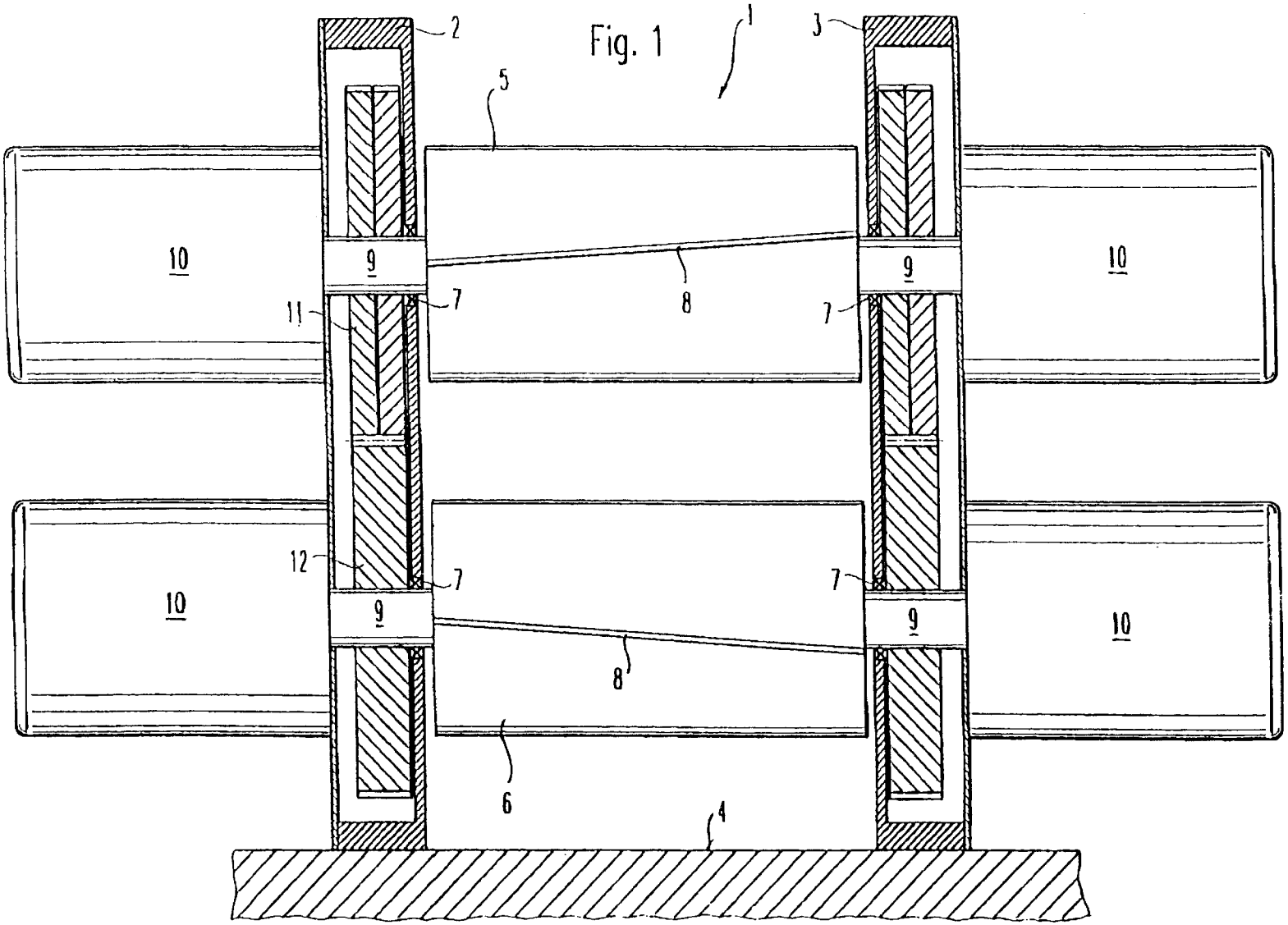
FIG. 1 a schematic vertical cross-section of a cutting device for a continuous material, in particular, a continuous corrugated web.

The cutting device 1 possesses vertical, stable and parallel mounting parts 2 and 3, which rest on the base 4.

In mounting parts 2 and 3, cutter bars 5 and 6 run along bearings above bearing 7 in such a way that they can rotate. Cutter bars 5 and 6 support blades 8 which are employed across from the longitudinal axis, running in the lengthwise direction.

Cutter bars 5 and 6 should preferably be hollow. They have axle stubs 9 at their ends. Cutter bars 5 and 6 should preferably be composed mainly of fiber-reinforced material. Axle stubs 9 are made of metal.

One driving motor 10 is connected directly to each axle stub 9. However, each driving motor 10 can also be connected by means of a coupling with axle stubs 9 (not illustrated). The driving motors 10 should preferably be electric. However, they can also be hydraulic.

The cutter bars 5 and 6 placed over one another comprise a cutter bar pair. Cutter bars 5 and 6 are placed parallel to one another in mounting parts 2 and 3.

Gears 11 and 12 sit on axle stubs 9. The upper gears 11 are separated into two separate gear components. One gear component of each gear 11 is seated on axle stub 9 so that it may not rotate with respect to the axle sub. The other gear component is mounted on axle stub 9 so that it can rotate with respect to the axle stub. These gears 11 and 12 intermesh with one another on each axle stub 9. The gear pairs provide a mechanical drive connection between the upper and lower cutter bars 5 and 6 to ensure that the cutter bars rotate in the proper synchronization. Since gears 11 and 12 are used only to maintain synchronization and are not used to transfer the entire driving force from one bar to another, the gears can be constructed relatively thinly. It will be appreciated that the separated gears 11 are shown only for purposes of example, and that gears 12 may alternatively be separated into two components, with gears 11 comprising a single component.

The diameters of cutter bars 5 and 6 are set such that their blades 8, while passing crosswise through the continuous material which is to be cut, continually contact one another and cut while turning. Because motors 10 on each end of a cutter bar 5 and 6 need assume only a limited portion of the power required to drive the respective utter bar and are therefor relatively small in size, the motors can be positioned directly on each cutter bar 5 and 6 at both ends. In this way the angular momentum of the rotating masses of the driving motors and the gears is minimized.

Figure 2:
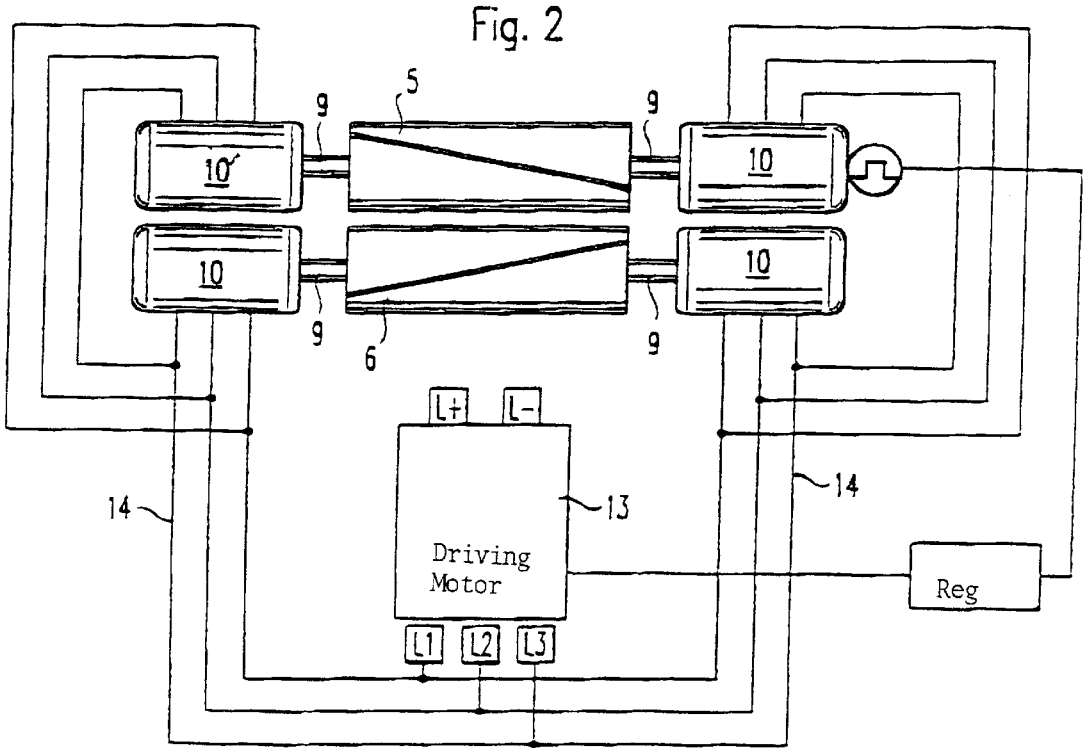
FIG. 2 an electrical automated logic diagram for a control system for the cutting device drive for synchronism, rotational speed and/or number of revolutions.
Figure 3:
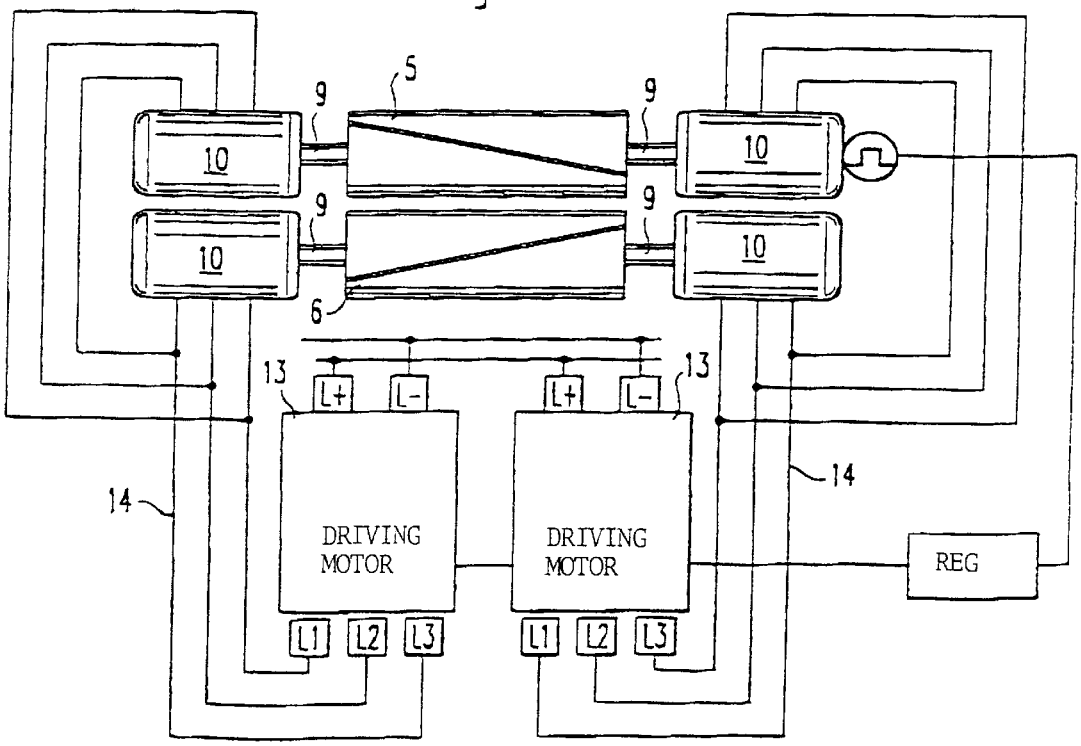
FIG. 3 an automated logic diagram for a different design of the invention.

Instead of the mechanical driving connection of axle stubs 9 on cutter bars 5 and 6, an electrical solution as demonstrated in FIGS. 2 and 3 can be provided for the exact synchronization of the cutter bar pair. Driving motors 10 are powered through electrical lines 14 under the control of synchronization and rotational speed control 13. The synchronization and rotational speed control 13 may comprise a three-phase generator driven by a suitable motor. Either a single control system 13 can be used, as in FIG. 2, or two, as in FIG. 3. A control system of motors 10 is possible as illustrated, positioned in pairs above one another. In addition, motors 10 can be controlled in pairs adjacent to one another. Finally, individual control of motors 10 is also possible.

What is claimed is:

1. A cutting device for cutting a continuous sheet of material, the cutting device comprising:

(a) a first elongated cutter bar mounted for rotation about its longitudinal axis and carrying a longitudinally mounted and radially extending first blade;

(b) a second elongated cutter bar mounted for rotation about its longitudinal axis and carrying a longitudinally mounted and radially extending second blade, the second cutter bar extending substantially parallel to the first cutter bar and being spaced apart from the first cutter bar;

(c) a synchronizing arrangement for synchronizing the rotation of the first cutter bar about its longitudinal axis with the rotation of the second cutter bar about its longitudinal axis so that the first blade passes the second blade generally in a plane of the material to be cut, the first blade and second blade cooperating as they pass each other to provide a cutting action there between;

(d) a first drive motor connected to drive the first cutter bar at a first end thereof and a second drive motor connected to drive the first cutter bar at a second end thereof; and (e) a third drive motor connected to drive the second cutter bar at a first end thereof, and a fourth drive motor connected to drive the second cutter bar at a second end thereof.

2. The cutting device of claim 1 wherein the first cutter bar and the second cutter bar are both composed at least partially of fiber-reinforced material.

3. The cutting device of claim 2 wherein the synchronizing arrangement includes:

(a) a first gear operatively connected to the first cutter bar and comprising two separate gear components, one gear component rigidly connected to the first cutter bar and one gear component adapted to rotate with respect to the first cutter bar; and (b) a second gear operatively connected to the second cutter bar, the second gear being intermeshed with both gear components of the first gear.

4. The cutting device of claim 3 wherein the synchronization arrangement includes:

(a) an electric control system connected to each motor for controlling rotational synchronization between the first cutter bar and second cutter bar, and for controlling the rotational speed of the first cutter bar and second cutter bar.

5. The cutting device of claim 2 wherein the synchronization arrangement includes:

(a) an electric control system connected to each motor for controlling rotational synchronization between the first cutter bar and second cutter bar, and for controlling the rotational speed of the first cutter bar and second cutter bar.

6. The cutting device of claim 1 wherein the synchronizing arrangement includes:

(a) a first gear operatively connected to the first cutter bar and comprising two separate gear components, one gear component rigidly connected to the first cutter bar and one gear component adapted to rotate with respect to the first cutter bar; and (b) a second gear operatively connected to the second cutter bar, the second gear being intermeshed with both gear components of the first gear.

7. The cutting device of claim 6 wherein the synchronization arrangement includes:

(a) an electric control system connected to each motor for controlling rotational synchronization between the first cutter bar and second cutter bar, and for controlling the rotational speed of the first cutter bar and second cutter bar.

8. The cutting device of claim 1 wherein the synchronization arrangement includes: (a) an electric control system connected to each motor for controlling rotational synchronization between the first cutter bar and second cutter bar, and for controlling the rotational speed of the first cutter bar and second cutter bar.

* * * * *

UNITED STATES PATENT AND TRADEMARK OFFICE

CERTIFICATE OF CORRECTION

PATENT NO. : 6,142,048

DATED : November 7, 2000

INVENTOR(S) : Edward Bradatsch, et al.

It is certified that error appears in the above-identified patent and that said Letters Patent is hereby corrected as shown below:

In Claim 3, column 3, line 24 of the Patent, change "2" to --1--.

In Claim 4, column 3, line 35 of the Patent, change "3" to --1--.

In Claim 6, column 4, line 11 of the Patent, change "1" to --2--.

In Claim 7, column 4, line 23 of the Patent, change "6" to --3--.

In Claim 8, column 4, line 31 of the Patent, change "1" to --6--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*